US008960174B2

(12) United States Patent
Khoshnood

(10) Patent No.: US 8,960,174 B2
(45) Date of Patent: Feb. 24, 2015

(54) ARROW REST LOCKING MECHANISMS

(76) Inventor: Bahram Khoshnood, Cumming, GA (US)

( * ) Notice: Subject to any disclaimer, the term of this patent is extended or adjusted under 35 U.S.C. 154(b) by 549 days.

(21) Appl. No.: 13/310,754

(22) Filed: Dec. 3, 2011

(65) Prior Publication Data

US 2013/0139798 A1 Jun. 6, 2013

(51) Int. Cl.
*F41B 5/22* (2006.01)
*F41B 5/14* (2006.01)

(52) U.S. Cl.
CPC ..... *F41B 5/143* (2013.01)
USPC ..... 124/44.5

(58) Field of Classification Search
CPC ..... F41B 5/143
USPC ..... 124/44.5
See application file for complete search history.

(56) References Cited

U.S. PATENT DOCUMENTS 4,453,528 A * 6/1984 Eckert ..... 124/44.5
4,686,956 A * 8/1987 Troncoso, Jr. ..... 124/44.5
4,803,971 A * 2/1989 Fletcher ..... 124/44.5
5,365,912 A * 11/1994 Pittman ..... 124/44.5
5,394,858 A * 3/1995 Karolian ..... 124/44.5
5,490,492 A * 2/1996 Savage ..... 124/44.5
5,601,069 A * 2/1997 Clark ..... 124/44.5
5,632,263 A * 5/1997 Sartain ..... 124/44.5
6,044,832 A * 4/2000 Piersons, Jr. ..... 124/44.5
6,202,635 B1 * 3/2001 Evans ..... 124/44.5
6,595,195 B1 * 7/2003 Barner et al. ..... 124/44.5
6,615,813 B1 * 9/2003 Troncoso et al. ..... 124/44.5
6,634,349 B2 * 10/2003 Mizek et al. ..... 124/44.5
6,684,871 B1 * 2/2004 Troncoso et al. ..... 124/44.5
6,782,881 B2 * 8/2004 Mizek et al. ..... 124/44.5
6,789,536 B1 * 9/2004 Summers ..... 124/44.5
6,823,856 B2 * 11/2004 Rager ..... 124/44.5
6,913,008 B2 * 7/2005 Simo et al. ..... 124/44.5
6,915,791 B2 * 7/2005 Harwath et al. ..... 124/44.5
7,219,662 B1 * 5/2007 Henry ..... 124/44.5
7,311,099 B2 * 12/2007 Rager ..... 124/44.5
7,331,338 B2 * 2/2008 Mizek ..... 124/44.5
7,409,950 B2 * 8/2008 Ellig et al. ..... 124/44.5
7,681,566 B2 * 3/2010 Mertens ..... 124/44.5
7,717,103 B2 * 5/2010 Johnson ..... 124/44.5
7,913,678 B2 * 3/2011 Hudkins ..... 124/44.5
7,980,237 B1 * 7/2011 Rasor et al. ..... 124/44.5
8,333,180 B2 * 12/2012 Mizek ..... 124/44.5
8,474,443 B2 * 7/2013 Geno ..... 124/44.5
8,544,457 B1 * 10/2013 Munsell et al. ..... 124/44.5
2004/0139953 A1 * 7/2004 Harwath et al. ..... 124/44.5
2004/0139954 A1 * 7/2004 Mizek et al. ..... 124/44.5
2006/0157038 A1 * 7/2006 Ellig et al. ..... 124/44.5
2006/0162709 A1 * 7/2006 Roberts et al. ..... 124/44.5
2008/0236556 A1 * 10/2008 Sims et al. ..... 124/24.1
2010/0263651 A1 * 10/2010 Evans ..... 124/44.5
2011/0067682 A1 * 3/2011 Blosser et al. ..... 124/87
2012/0138035 A1 * 6/2012 Ellig ..... 124/44.5

* cited by examiner

*Primary Examiner* — Gene Kim
*Assistant Examiner* — Alexander Niconovich
(74) *Attorney, Agent, or Firm* — Brient Globerman, LLC

(57) ABSTRACT

An arrow rest for a bow, according to various embodiments, comprises (1) a launcher, (2) a cord, and (3) a locking mechanism disposed adjacent the launcher. The launcher is adapted to lift an arrow from a first position to a second, ready-to-fire position, the cord is adapted to move the arrow rest from the first position to the second, ready-to-fire position when the cord is pulled, and the locking mechanism is selectively adapted to exert opposing lateral forces on the cord to selectively lock the cord in place while the launcher is in the second, ready-to-fire position.

21 Claims, 18 Drawing Sheets

ARROW REST LOCKING MECHANISMS

BACKGROUND

Arrow rests are used in combination with a bow to support an arrow during draw and release of the bow's bowstring. Arrow rests may be designed to lift an arrow into a firing position as the bowstring is drawn by an archer. At times, it may be useful to lock the arrow rest in the firing position. Accordingly, there is a need for effective designs for locks to serve this purpose.

SUMMARY

An arrow rest for a bow, according to various embodiments, comprises: (A) a launcher that is adapted to support an arrow, the launcher being mounted to selectively move between a first position and a second, ready-to-fire position; (B) a cord that is connected to move the launcher, in response to the cord being pulled, from the first position to the second, ready-to-fire position and to thereby lift an arrow supported at least partially by the launcher, into a ready-to-fire position; and (C) a locking mechanism that is adapted to selectively exert opposing lateral forces on at least a portion of the cord to thereby maintain the portion of the cord in a substantially fixed position relative to the locking mechanism and thereby lock the launcher is in the second, ready-to-fire position.

An arrow rest, according to certain embodiments, comprises: (A) a launcher that is adapted to support an arrow, the launcher being mounted to selectively move between a first position and a second, ready-to-fire position; (B) a cord that is connected to move the launcher, in response to the cord being pulled, from the first position to the second, ready-to-fire position and to thereby lift an arrow supported at least partially by the launcher, into a ready-to-fire position; and (C) a clip disposed adjacent the launcher, wherein the clip comprises a first end, a second end, and a biasing mechanism. In various embodiments, the biasing mechanism is adapted to bias the first end and the second end toward each other, and the first end and the second end of the clip are adapted to selectively exert opposing lateral forces on at least a portion of the cord to thereby maintain the portion of the cord in a substantially fixed position relative to the clip and thereby lock the launcher is in the second, ready-to-fire position.

An arrow rest, according to various embodiments, comprises: (A) a launcher that is adapted to support an arrow, the launcher being mounted to selectively move between a first position and a second, ready-to-fire position; (B) a cord that is connected to move the launcher, in response to the cord being pulled, from the first position to the second, ready-to-fire position and to thereby lift an arrow supported at least partially by the launcher, into a ready-to-fire position; and (C) a locking mechanism disposed adjacent the launcher. In various embodiments, the cord comprises a bulge and the bulge is adapted to cooperate with the locking mechanism to lock the arrow rest in the second ready-to-fire position.

BRIEF DESCRIPTION OF THE DRAWINGS

Having described various embodiments in general terms, reference will now be made to the accompanying drawings, which are not necessarily drawn to scale, and wherein.

DETAILED DESCRIPTION OF VARIOUS EMBODIMENTS

Figure 1:
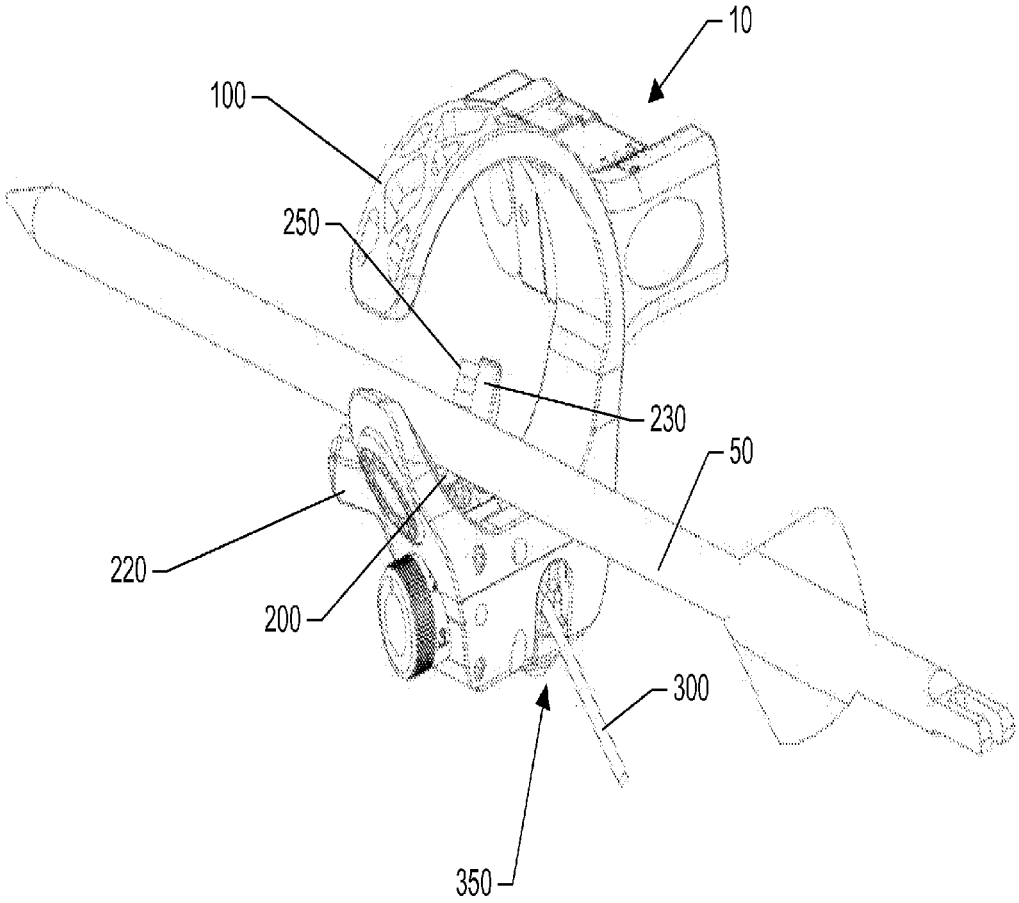
FIGS. 1-3 are perspective views of a first embodiment of a drop away arrow rest as an arrow is moved from a first, dropped away position to a second, ready-to-fire position.
Figure 2:
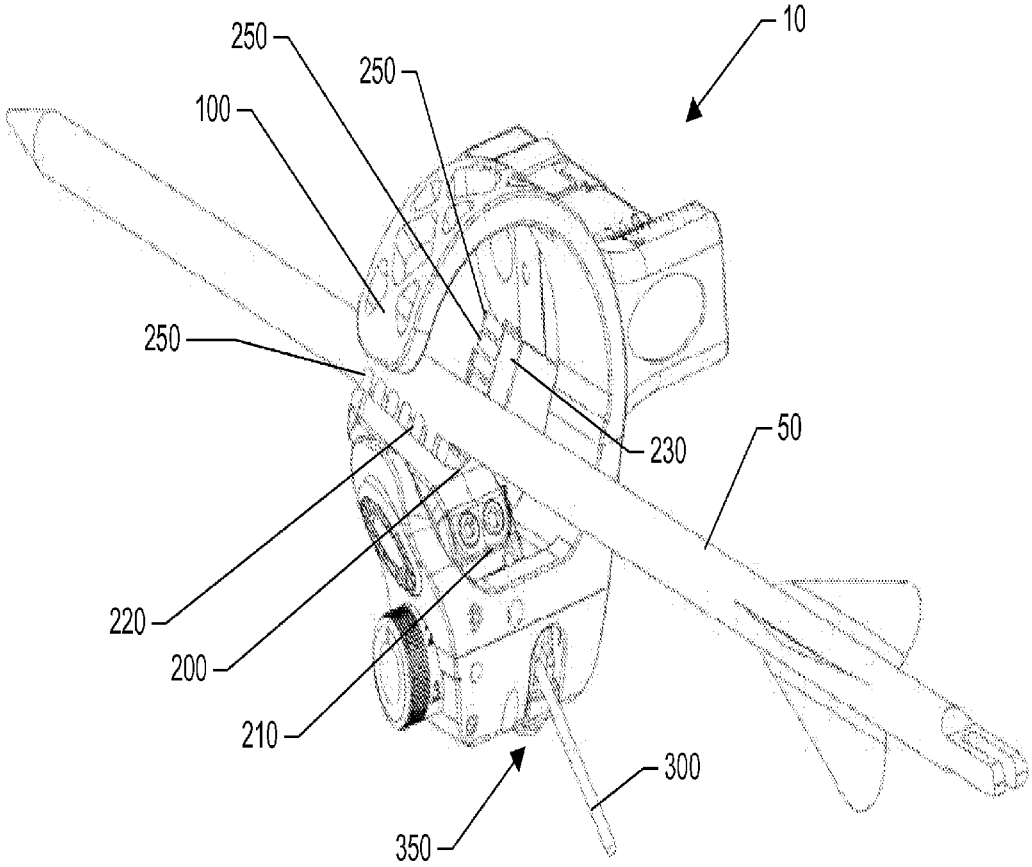
Figure 3:
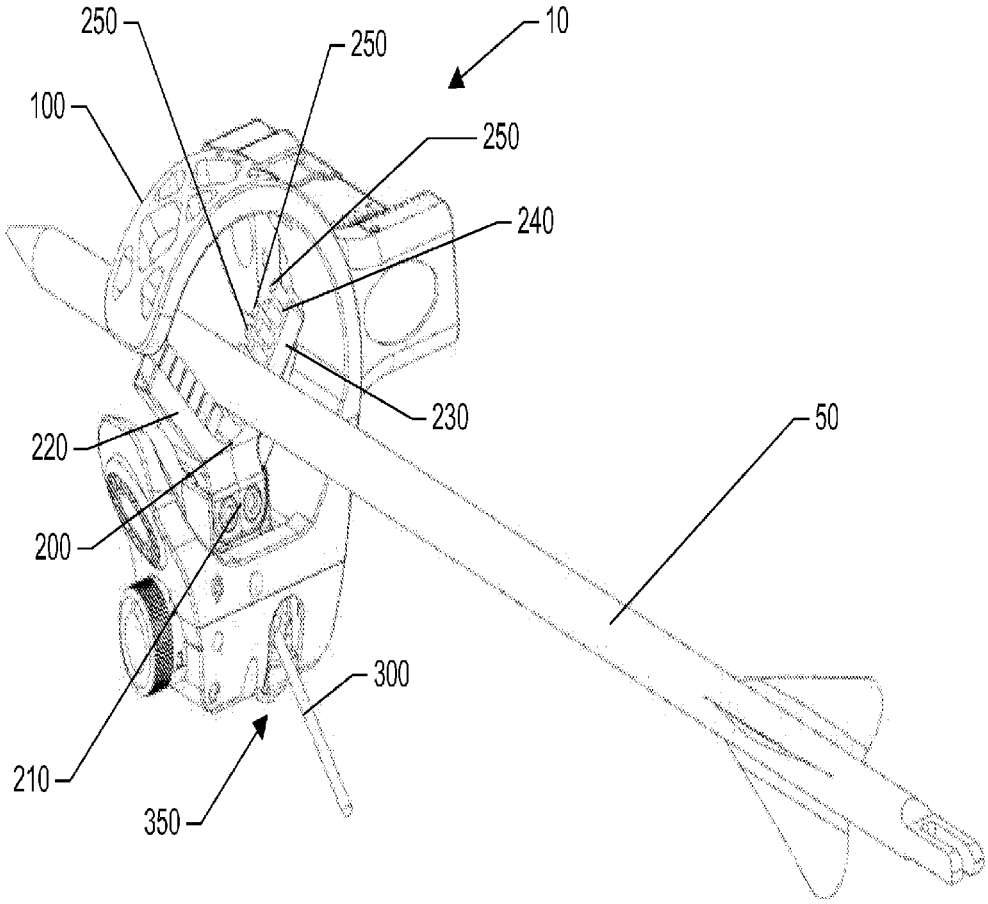

A drop away arrow rest 10 according to a first embodiment is shown in FIGS. 1-4. FIG. 1 shows the drop away arrow rest 10 in a first, dropped away position and FIG. 3 shows the drop away arrow rest 10 in a second, ready-to-fire position. In this embodiment, the drop away arrow rest 10 comprises: (1) a V-shaped launcher 200; (2) a C-shaped enclosure 100; (3) a cord 300; (4) a plurality of brushes 250 disposed adjacent an interior arrow support surface of the V-shaped launcher 200; and (5) a locking mechanism 350. These various components are discussed in greater detail below.

V-Shaped Launcher

In the embodiment shown in FIG. 3, the V-shaped launcher 200 includes a substantially straight (e.g., straight) base piece 210 that is pivotally attached (e.g., to) adjacent the base of the C-shaped enclosure 100. As may be understood form FIGS. 1-3, the V-shaped launcher is adapted to pivot about the lower end of the base piece 210. As shown in FIG. 3, the base piece 210 of the V-shaped launcher 200 extends substantially vertically (e.g., vertically) from the base of the C-shaped enclosure 100 when the V-shaped launcher 200 is in a second, ready-to-fire position and the drop away arrow rest 10 is in a substantially vertical (e.g., vertical) orientation. As may be understood from FIG. 3, the base piece 210 of the V-shaped launcher 200 is substantially perpendicular to the ground when the V-shaped launcher 200 is in the second, ready-to-fire position and the drop away arrow rest 10 is in an upright orientation.

As shown in FIG. 3, the V-shaped launcher 200 comprises two arrow supports 220, 230 that cooperate to form a V-shape from the top end of the base piece 210 of the V-shaped launcher. In the embodiment shown in FIG. 3, the arrow supports 220, 230 are substantially straight (e.g., straight). In other embodiments of the V-shaped launcher 200, the arrow supports 220, 230 may be curved. In the embodiment shown in FIG. 3, the first arrow support 220 extends upwardly and away from the second arrow support 230 at an angle of at least about forty five degrees (e.g., forty five degrees) from vertical. The second arrow support 230 extends upwardly and away from the first arrow support 220 at an angle of at least about forty five degrees from vertical. The first and second arrow supports 220, 230 form an angle of about ninety degrees between them.

In other embodiments of the V-shaped launcher 200, the first and second arrow supports 220, 230 may extend at any suitable angle from the base piece 210 such that an arrow can fit between the first and second arrow supports 220, 230. In the embodiment shown in FIG. 3, the first and second arrow supports 220, 230 are substantially planar (e.g., planar). When the V-shaped launcher is in the second, ready-to-fire position as shown in FIG. 3, the plane of the substantially V-shape (e.g., V-shape) formed by the first and second arrow supports 220, 230 is disposed substantially perpendicular to (e.g., perpendicular to) the direction in which an arrow would be fired from the bow.

In the embodiment of the V-shaped launcher 200 shown in FIGS. 1-4, the arrow supports 220, 230 define an interior arrow support surface 240 as shown in FIG. 3. The interior arrow support surface 240 is adapted to support the shaft of an arrow 50 when the V-shaped launcher 200 is in the second, ready-to-fire position. In the embodiment shown in FIGS. 1-4, the interior arrow support surface 240 of the two arrow supports 220, 230 further include a plurality of brushes 250.

The V-shaped launcher 200 may include a biasing mechanism for biasing the V-shaped launcher 200 toward a particular home position. In the embodiment shown in FIGS. 1-4, the particular home position may be a first, dropped away position as shown in FIG. 1. In particular embodiments, the biasing mechanism may include a torsion spring. In other embodiments, the biasing mechanism may include any other suitable mechanism for biasing the V-shaped launcher 200 towards the particular home position (e.g., a linear spring). In the embodiment shown in FIG. 1, the V-shaped launcher 200 includes a stopping mechanism that is adapted to prevent the biasing mechanism from biasing the V-shaped launcher 200 past the first, dropped away position. The stopping mechanism may include any suitable mechanism for preventing the biasing mechanism from biasing the V-shaped launcher 200 past the first, dropped away position (e.g., a pin).

Other embodiments of the V-shaped launcher may include arrow supports 220, 230 that form a shape other than a V-shape (e.g., a U-shape, a horizontal bar, or any other suitable shape to support an arrow). The V-shaped launcher 220 may be made of any suitable material (e.g., a suitable metal such as aluminum or steel, or plastic).

C-Shaped Enclosure

As shown in FIG. 3, in particular embodiments, the C-shaped enclosure 100 extends around the V-shaped launcher 200 in a substantially C-shape (e.g., C-shape) when the V-shaped launcher 200 is in the second, ready-to-fire position. As shown in FIG. 3, the V-shaped launcher 200 and C-shaped enclosure 100 are oriented in substantially the same plane when the V-shaped launcher 200 is in the second, ready-to-fire position.

In the embodiment shown in FIG. 3, the C-shaped enclosure 100 includes a first opening. In particular embodiments, the first opening in the C-shaped enclosure 100 is sufficiently large to allow the shaft of an arrow to pass through the first opening.

In the embodiment shown in FIG. 3, the C-shaped enclosure 100 is adapted to cooperate with the V-shaped launcher 200 to maintain an arrow within the C-shaped enclosure 100 when the arrow is in the second, ready-to-fire position. As may be understood from FIG. 3, when the V-shaped launcher 200 is in the second, ready-to-fire position, the left arrow support of the V-shaped launcher 200 substantially obstructs (e.g., obstructs) the first opening in the C-shaped enclosure 100 such that the shaft of an arrow may no longer be able to pass through the first opening of the C-shaped enclosure 100.

In the embodiment shown in FIG. 1, the C-shaped enclosure 100 comprises a second opening. In this embodiment, the second opening is disposed at the rear base of the C-shaped enclosure 100. In the present embodiment, the second opening is sufficiently large to allow a cord 300 to pass through the second opening. In the embodiment shown in FIG. 1, the second opening may be adapted to house the locking mechanism 350.

In particular embodiments, the C-shaped enclosure 100 may be made of any suitable material (e.g., any suitable metal such as aluminum, or plastic).

Cord

Figure 4:
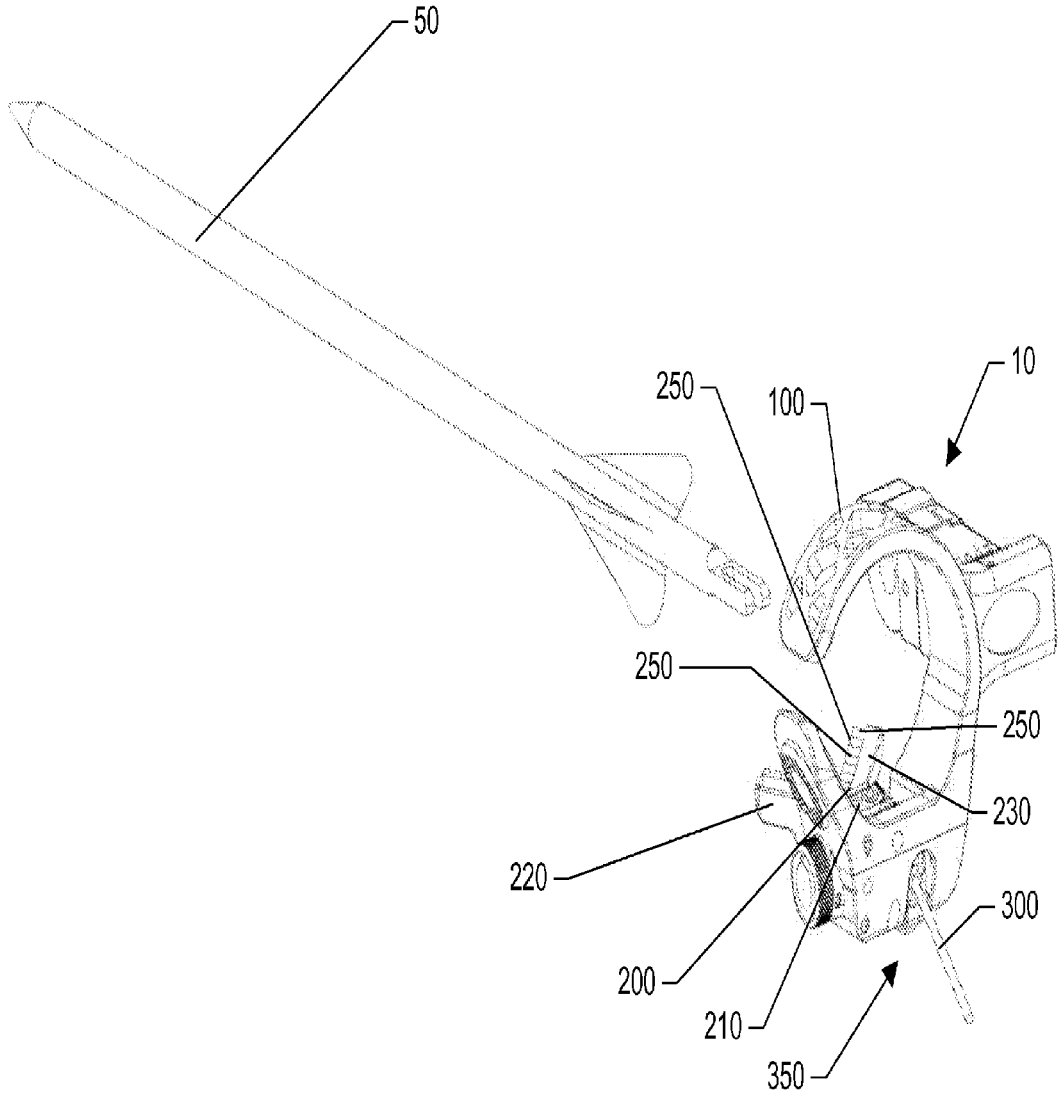
FIG. 4 is a perspective view of the drop away arrow rest of FIG. 1 immediately following the firing of the arrow.

In the embodiment shown in FIG. 4, the cord 300 may be made of any appropriate, preferably strong and flexible, material (e.g., an appropriate synthetic material such as Kevlar). In various embodiments, the cord 300 may be any suitable flexible and/or rigid element (e.g., a string, line, cable, chain, or rod). In particular embodiments, the cord 300 may include string or rope made from several twisted or woven strands. In other embodiments, the cord 300 may include string or rope made from a single strand. In the embodiment shown in FIG. 4, the cord 300 runs through the second opening in the C-shaped enclosure 100 and through the locking mechanism 350. As may be understood from FIGS. 9-11, in particular embodiments, the cord 300 may be substantially coupled with (e.g., coupled with) the bowstring of an archery bow. As an archer pulls back on the arrow 50, the bowstring pulls back on the cord 300, which may cause the V-shaped launcher 200 to rise away from the first, dropped away position to the second, ready-to-fire position.

Brushes

In the embodiment shown in FIGS. 1-4, the drop away arrow rest 10 includes a plurality of brushes 250 attached adjacent (e.g., to) an interior arrow support surface 240 of the V-shaped launcher 200. In the embodiment shown in FIGS. 1-4, each of the plurality of brushes 250 comprises a plurality of individual bristles. As may be understood from FIG. 3, the brushes 250 extend substantially perpendicularly (e.g., perpendicularly) from the interior arrow support surface 240. In particular embodiments, the brushes may be made of any material that is sufficiently stiff to raise an arrow from the first, dropped away position and support the arrow in the second, ready-to-fire position and sufficiently flexible to provide some give or play when an archer is preparing to fire an arrow (e.g., nylon or any other suitable material).

Figure 5:
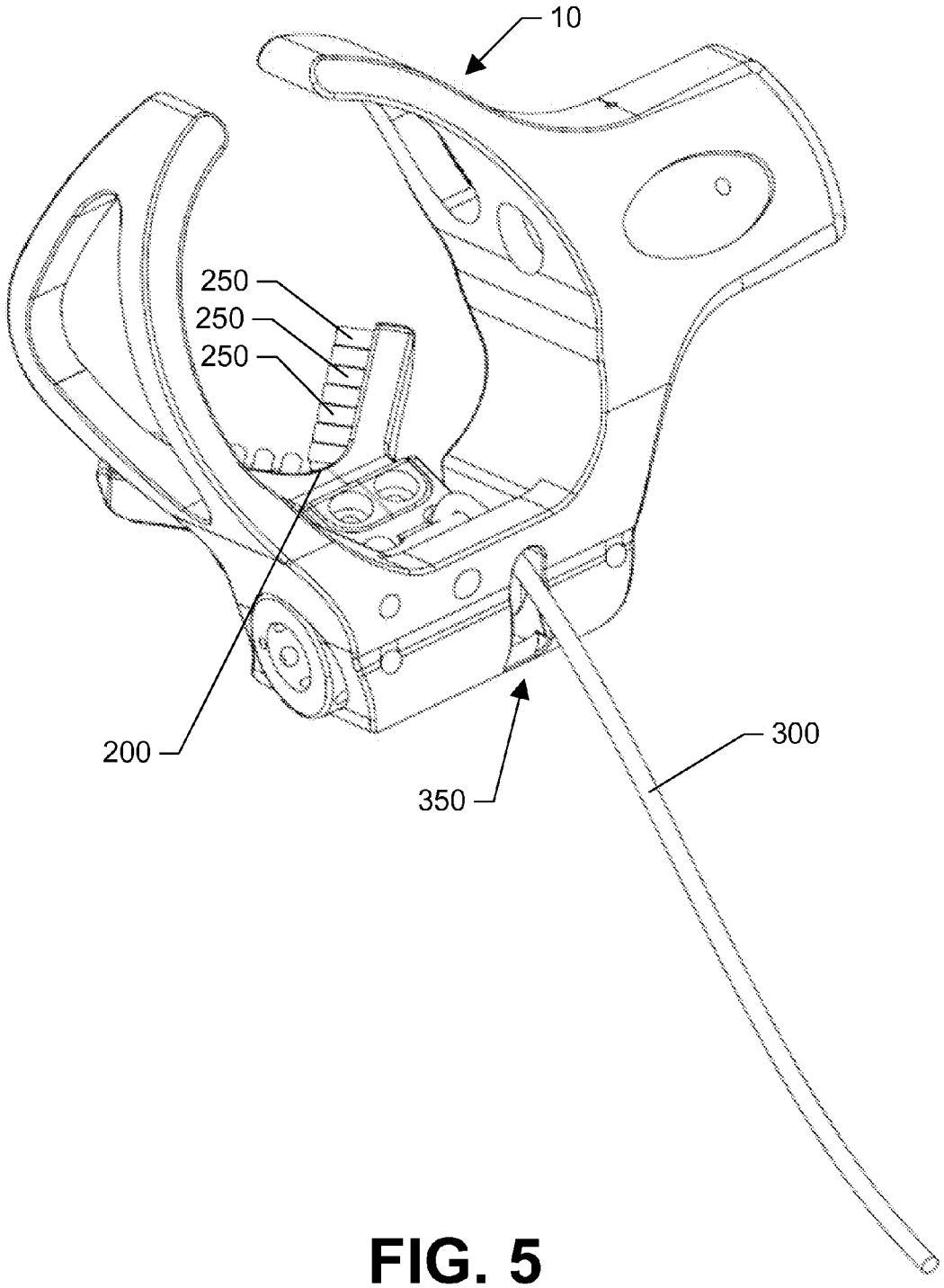
FIGS. 5-7 are perspective views of a second embodiment of a drop away arrow rest as the drop away arrow rest is moved from a first, dropped away position to a second, ready-to-fire position.

As shown in FIGS. 3 and 5, the brushes 250 are attached adjacent (e.g., to) an interior arrow support surface of the V-shaped launcher 200 in substantially circular (e.g., circular) clusters of bristles. In other embodiments of the drop away arrow rest, the brushes 250 may be disposed in any other suitable grouping of bristles (e.g., square or triangular). In particular embodiments of the drop away arrow rest 10, the brushes 250 may be disposed to cover substantially all (e.g., all) of the interior support surface of the V-shaped launcher 300.

In the embodiment shown in FIG. 3, the clusters of bristles have substantially the same (e.g., the same) diameter. In the embodiment shown in FIG. 4, the substantially circular (e.g., circular) clusters of bristles are spaced apart from one another by a distance approximately equal to (e.g., equal to) the diameter of the circular clusters of bristles. As shown in FIGS. 3 and 5, the brushes 250 are disposed adjacent (e.g., to) the interior arrow support surface of the V-shaped launcher 200 in staggered rows. The staggered rows are arranged such that the center of an individual brush 250 (e.g., a substantially circular (e.g., circular) cluster of bristles) is disposed substantially adjacent to (e.g., adjacent to) the midpoint of two adjacent brushes in an adjoining row.

Other embodiments of the drop away arrow rest 10 may include any appropriate arrangement of brushes 250. Certain embodiments of the drop away arrow rest may include a checkerboard arrangement of brushes 250 on the interior arrow support surface of the V-shaped launcher 200. Other embodiments may include any other suitable arrangement of brushes (e.g., a honeycomb arrangement, zigzag arrangement, etc.)

Locking Mechanism

In the embodiment shown in FIGS. 1-4, the drop away arrow rest 10 includes a locking mechanism 350. In various embodiments, the locking mechanism is adapted to cooperate with the cord 300 to lock the drop away arrow rest in the second, ready-to-fire position. In various embodiments, the locking mechanism 350 is adapted to exert opposing lateral forces on the cord 300 (e.g., pinch the cord 300) to lock the cord 300 when the drop away arrow rest 10 is in the second, ready to fire position. In the embodiment shown in FIG. 1, the locking mechanism 350 is disposed adjacent a rear lower portion of the C-shaped enclosure 100.

FIGS. 8A-G show various embodiments of a locking mechanism 350A, 350B-F. As may be understood from FIGS. 8A-F the locking mechanism may be adapted to exert opposing lateral forces on the cord 300 in order to lock the cord 300 in place. As shown in FIG. 8H, particular embodiments of the locking mechanism 350F may be adapted to cooperate with a bulge 360F in the cord 300 to lock the cord 300 in place.

Various embodiments of the locking mechanism are described below.

First Locking Mechanism Embodiment

Figure 8A:
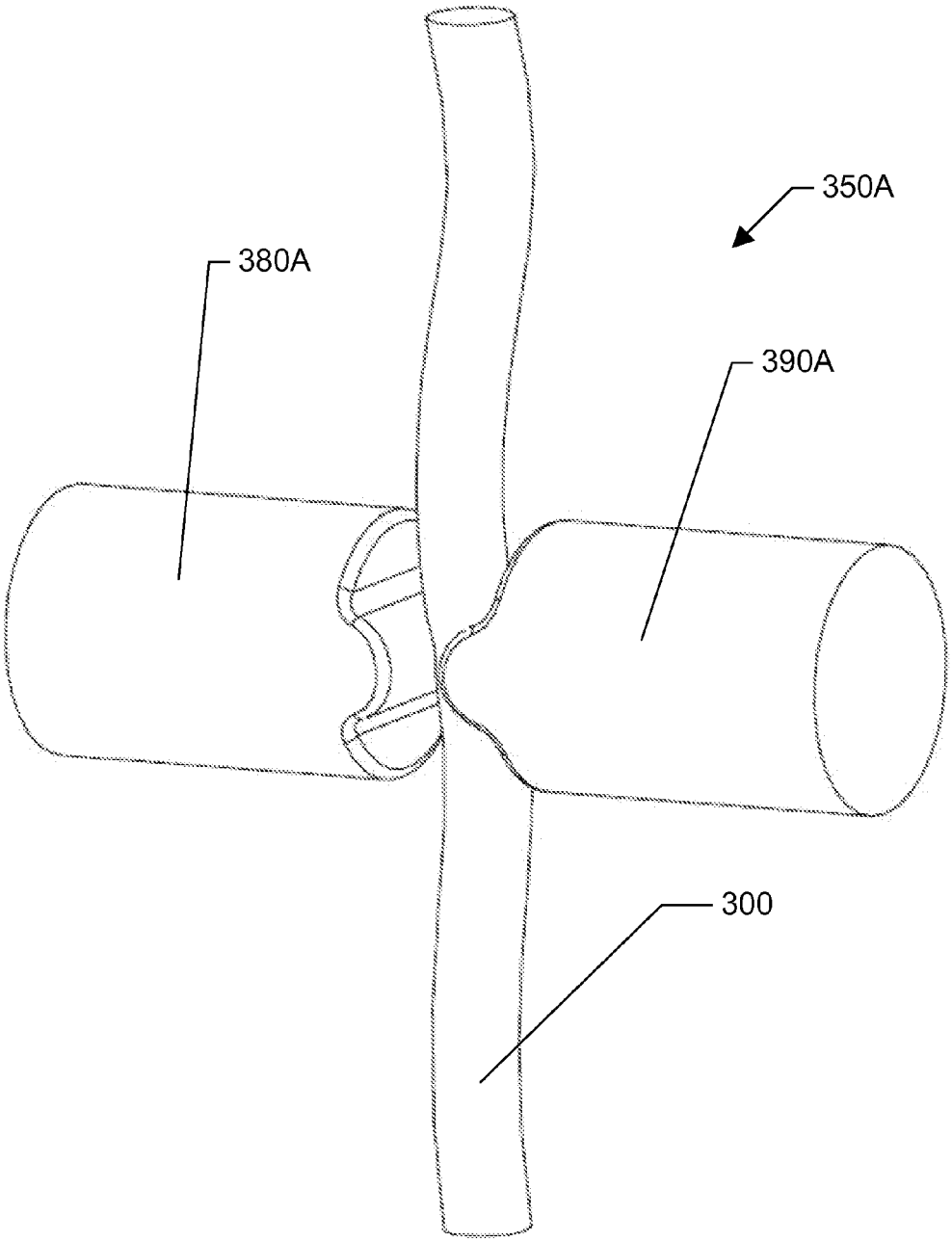
FIG. 8A is a perspective view of a first embodiment of a locking mechanism.

A first embodiment of a locking mechanism 350A is shown in FIG. 8A. The first embodiment of a locking mechanism 350A comprises a first cylinder 380A and a second cylinder 390A. In the first embodiment shown in FIG. 8A, the first and second cylinders 380A, 390A are substantially circular (e.g., circular) cylinders. In other embodiments, the first and second cylinders may have any appropriately shaped profile (e.g., rectangular or triangular). In this embodiment, the first and second cylinders are disposed substantially co-linearly (e.g., co-linearly). A locking mechanism 350A according to the first embodiment may, for example, be housed within any appropriate enclosure. For example, the first cylinder 380A and the second cylinder 390A may each be disposed within an opening that substantially corresponds to (e.g., corresponds to) the profile and size of the first and second cylinders 380A, 390A.

As may be understood from FIG. 8A, the first cylinder 380A is adapted to exert a lateral force against the cord 300, and the second cylinder 390A is adapted to exert a lateral force against the cord 300 that opposes the lateral force of the first cylinder 380*a* when the cord 300 is between the first and second cylinders 380A, 390A. The first embodiment of the locking mechanism 350A may include a first and second biasing mechanism that are adapted to bias the first and second cylinders 380A, 390A toward each other and against the cord 300. In the first embodiment of the locking mechanism 350A, the first cylinder 380A and second cylinder 390A are adapted to cooperate to pinch together to hold the cord 300 in place when the drop away arrow rest 10 is in the second, ready-to-fire position.

Various embodiments of the locking mechanism may further comprise at least one tooth on the end of the first cylinder 380A, second cylinder 390A, or both 380A, 390A. In particular embodiments, the tooth may comprise a protrusion that extends from the portion of the first or second cylinder 380A, 390A that pinches against the cord 300.

Second Locking Mechanism Embodiment

Figure 8B:
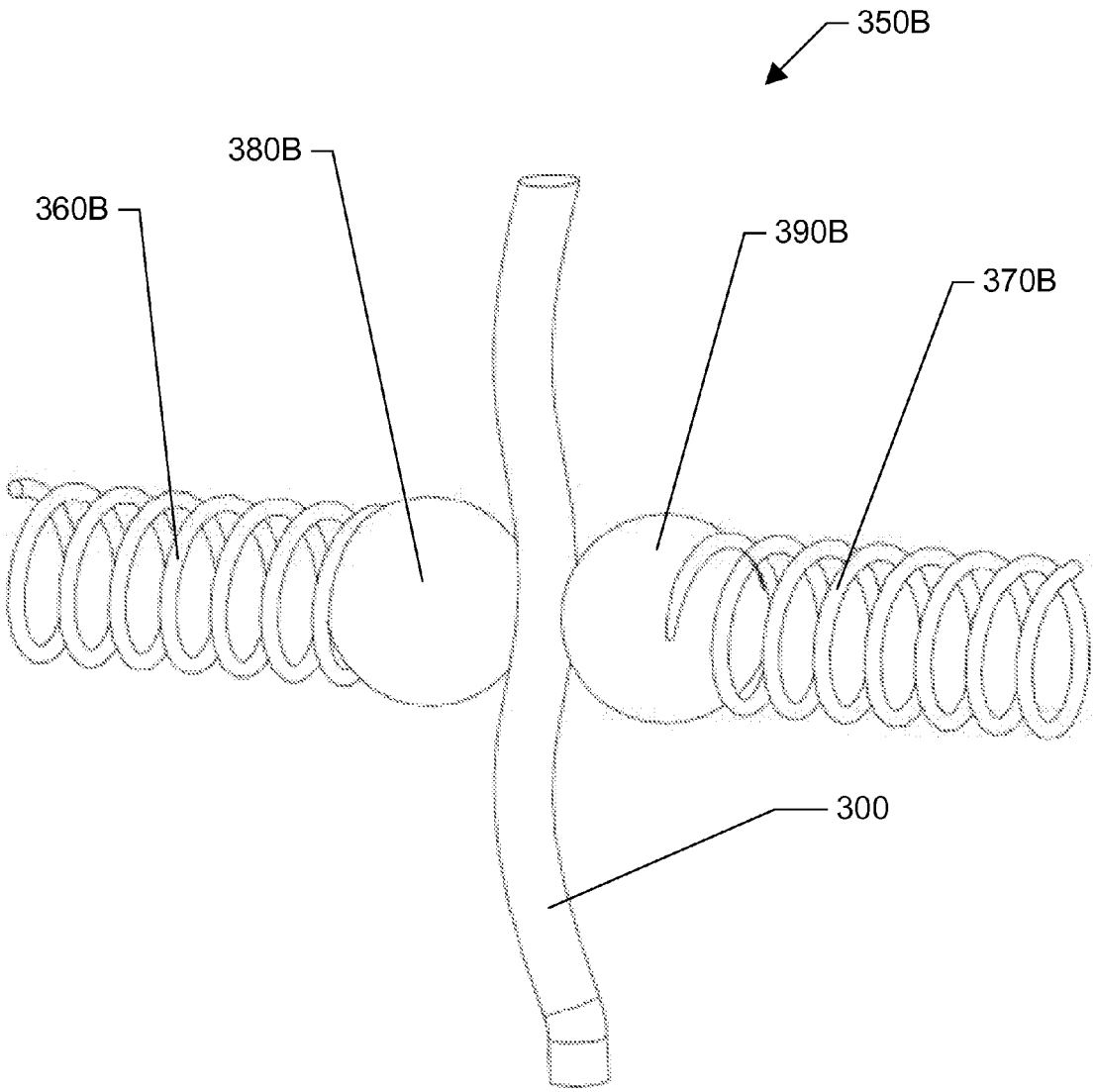
FIG. 8B is a perspective view of a second embodiment of a locking mechanism.

A second embodiment of a locking mechanism 350B is shown in FIG. 8B. The second embodiment of the locking mechanism 350B comprises a first biasing mechanism 360B, a second biasing mechanism 370B, a first ball bearing 380B, and a second ball bearing 390B. In the second embodiment of the locking mechanism 350B, the first and second ball bearings are substantially spherical (e.g., spherical). In other embodiments, the first and second ball bearings may be any other appropriate shape (e.g., cubic). In the embodiment shown in FIG. 8B, the first and second biasing mechanisms 360B, 370B are disposed adjacent an exterior portion of the first and second ball bearings 380B, 390B. In this embodiment, the first and second ball bearings 380B, 390B are disposed substantially co-linearly (e.g., co-linearly). A locking mechanism 350B in the second embodiment may be housed within any appropriate enclosure. For example, the first biasing mechanism 360B and first ball bearing 380B and the second biasing mechanism 370B and second ball bearing 390B may each be disposed within an opening that substantially corresponds to (e.g., corresponds to) the profile and size of the first and second ball bearings 380B, 390B.

As may be understood from FIG. 8B, the first biasing mechanism 360B is adapted to bias the first ball bearing 380B against the cord 300, and the second biasing mechanism 370B is adapted to bias the second ball bearing 390B against the cord 300 when the cord 300 is between the first and second ball bearings 380B, 390B. In the embodiment shown in FIG. 8B, the first and second biasing mechanisms 360B, 370B are springs. The first and second springs 360B, 370B may be sufficiently stiff to press the first and second ball bearings 380B, 390B together with sufficient force to hold the cord 300 in place between the first and second ball bearings 360B, 370B. In the second embodiment of the locking mechanism 350B shown in FIG. 8B, the first ball bearing 380B and second ball bearing 390B are adapted to exert opposing lateral forces on the cord 300 to pinch together to hold the cord 300 in place when the drop away arrow rest 10 is in the second, ready-to-fire position.

Third Locking Mechanism Embodiment

Figure 8C:
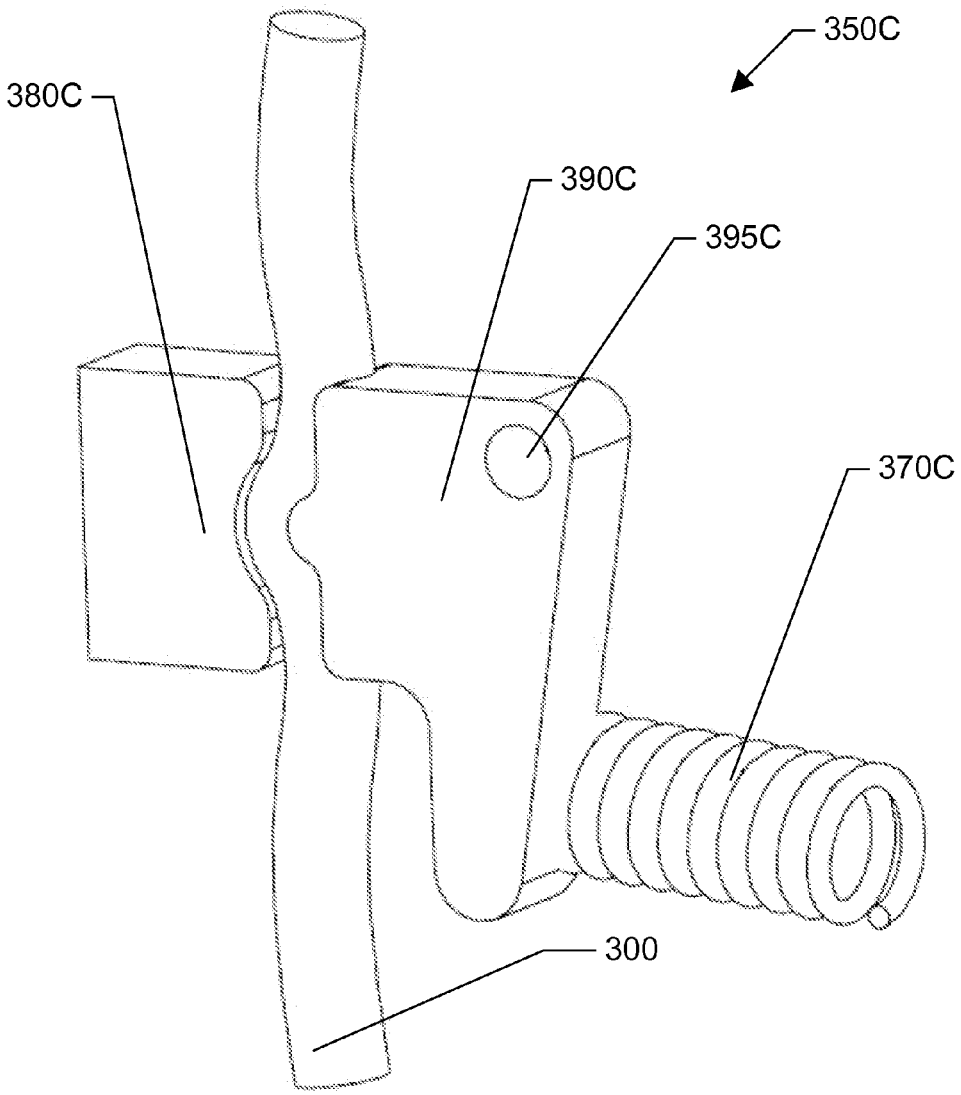
FIG. 8C is a perspective view of a third embodiment of a locking mechanism.

A third embodiment of the locking mechanism 350C is shown in FIG. 8C. The third embodiment of the locking mechanism comprises a first lock piece 380C, a second lock piece 390C pivotally mounted about a pin 395C, and a biasing mechanism 370C. In the third embodiment of FIG. 8C, the first lock piece 380 and second lock piece 390C are disposed adjacent (e.g., to) and spaced a distance apart from one another. In the third embodiment, the first lock piece 380C is a fixed extrusion made of any suitable material (e.g., a suitable metal such as aluminum, or plastic).

As shown in FIG. 8C, the face of the first lock piece 380C that contacts the cord 300 may have any suitable surface geometry. In the third embodiment shown in FIG. 8C, the face of the first lock piece 380C curves away from the second lock piece 390C. In various embodiments, the first lock piece 380C may have a substantially flat (e.g., flat) face. In particular embodiments, the face of the first lock piece 380C may have a surface geometry that corresponds with the face of the second lock piece 390C that contacts the cord 300. For example, as shown in FIG. 8C, the first lock piece 380C may have a face that curves inward, away from the second lock piece 390C while the second lock piece 390C has a face that comprises a protrusion that corresponds with the curve in the face of the first lock piece 380C.

As may be understood from FIG. 8C, the second lock piece 390C is pivotally mounted about a pin 395C. In the third embodiment of the locking mechanism 350C, the biasing mechanism 370C is disposed adjacent (e.g., to) an exterior portion of the second lock piece 390C a distance apart from the pin 395C. In the embodiment shown in FIG. 8C, the biasing mechanism 370C is adapted to bias the second lock piece 390C about the pin 395C and press the second lock piece against the cord 300 when the cord 300 is between the first lock piece 380C and the second lock piece 390C. In the embodiment shown in FIG. 8C, the biasing mechanism 370C is a spring. In this embodiment, the spring may be sufficiently stiff to press the second lock piece 390C against the cord 300 with sufficient force to hold the cord in place between the first lock piece 380C and the second lock piece 390C. In the third embodiment of the locking mechanism 350C, the first lock piece 380C and second lock piece 390C are adapted to exert opposing lateral forces that facilitate holding the cord 300 in place when the drop away arrow rest 10 is in the second, ready-to-fire position.

Fourth Locking Mechanism Embodiment

Figure 8D:
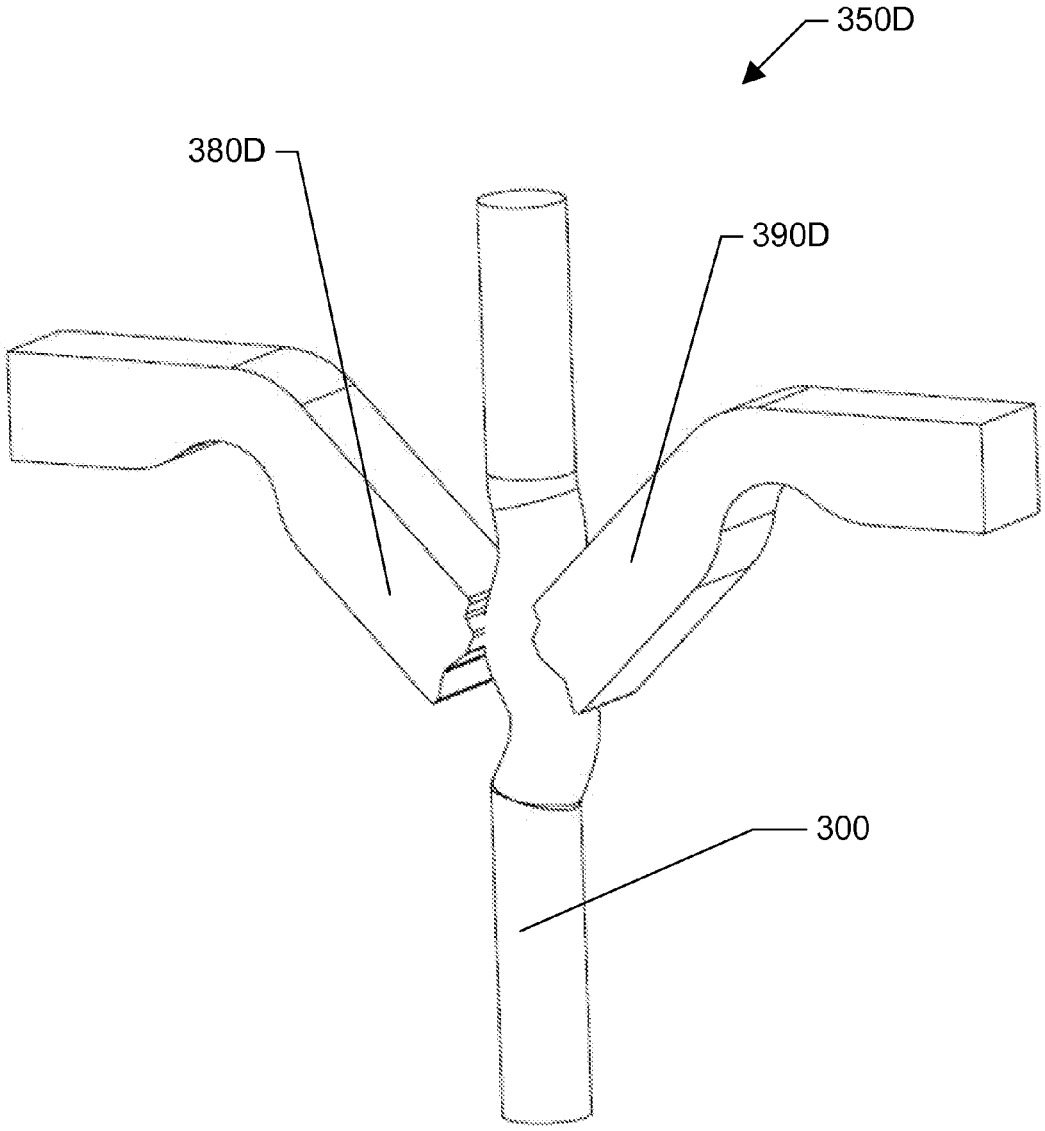
FIG. 8D is a perspective view of a fourth embodiment of a locking mechanism.

A fourth embodiment of the locking mechanism 350D is shown in FIG. 8D. The fourth embodiment of the locking mechanism 350D includes a first flexible member 380D and a second flexible member 390D. In this embodiment, the first and second flexible members are substantially co-planar (e.g., co-planer). As shown in FIG. 8D, the first flexible member 380D comprises a first end, and the second flexible member 390D comprises a second end. In this embodiment, the first and second ends are disposed substantially adjacent (e.g., to) on another.

In the embodiment shown in FIG. 8D, the first flexible member 380D and second flexible member 390D further comprise a first and second biasing mechanism. The first biasing mechanism is adapted to bias the first end of the first flexible member 380D toward the second end of the second flexible member 390D, and the second biasing mechanism is adapted to bias the second end of the second flexible member 390D toward the first end of the first flexible member 380D. In the fourth embodiment, the first flexible member 380D and second flexible member 390D are adapted to exert equal opposing forces against the cord 300 while the cord is between the first flexible member 380D and second flexible member 390D. Such opposing lateral forces facilitate the locking of the cord 300 between the first and second ends of the first and second flexible members 380D, 390D. The first and second flexible members 380D, 390D may be made of any suitable, preferably flexible material (e.g., a suitable metal such as aluminum, or plastic) that is sufficiently flexible to allow the cord 300 to slide between the first and second flexible members 380D, 390D and sufficiently stiff to lock the cord 300 in place between the first and second flexible members 380D, 390D.

Fifth Locking Mechanism Embodiment

Figure 8E:
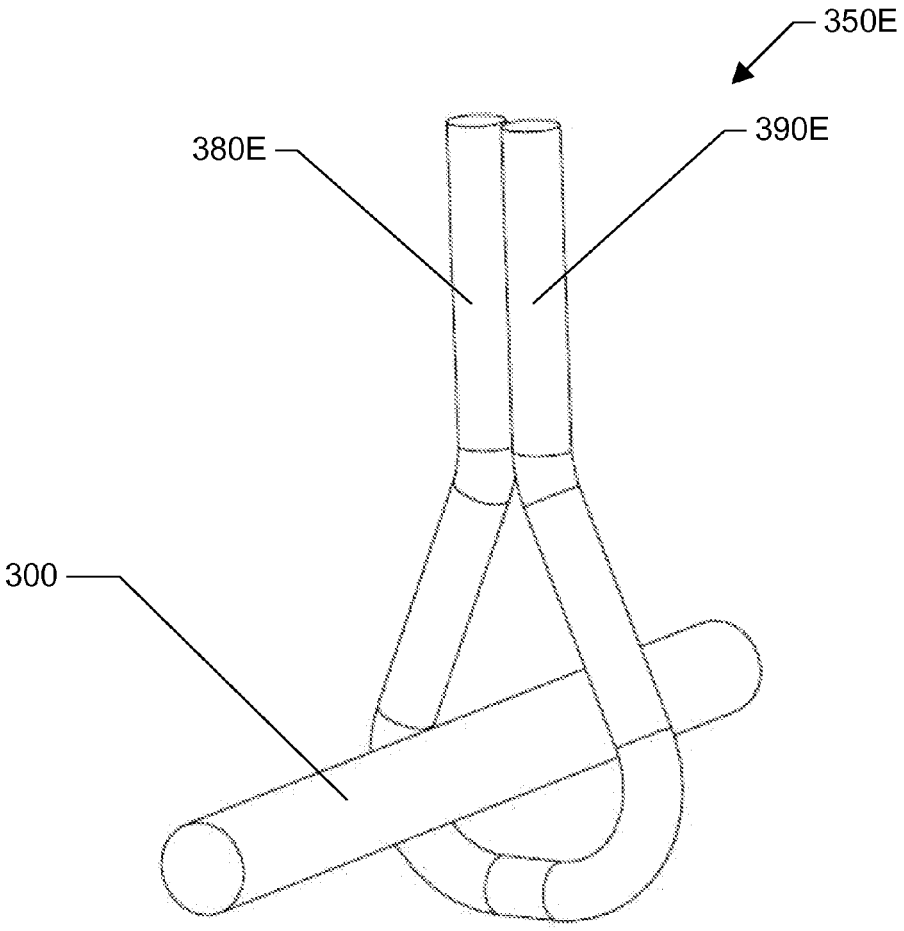
FIG. 8E is a perspective view of a fifth embodiment of a locking mechanism.
Figure 8F:
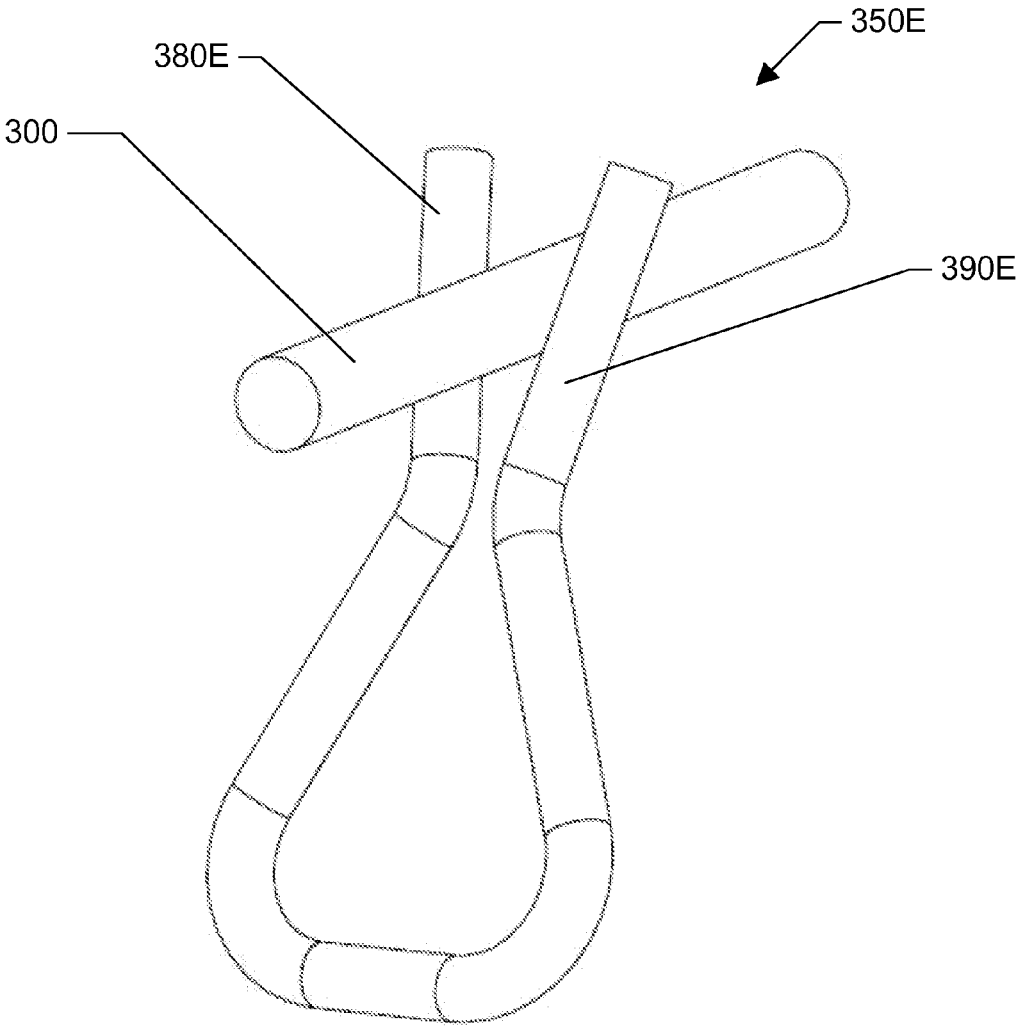
FIG. 8F is a perspective view of the locking mechanism of FIG. 8E with a cord in the locked position.

A fifth embodiment of the locking mechanism 350E is shown in FIGS. 8E and 8F. The fifth embodiment of the locking mechanism 350E includes a clip with a first end 380E and a second end 390E. In the embodiment shown in FIGS. 8E and 8F, the clip comprises a substantially continuous (e.g., continuous) tubular member that extends between the first end 380E and the second end 390E. As may be understood from FIG. 8E, the first end 380E and the second end 390E of the clip run substantially parallel (e.g., parallel) to one another when there is no cord 300 between the first and second ends 380E, 390E. In the embodiment shown in FIG. 8E, the remainder of the clip extends in a substantially tear drop shape (e.g., a tear drop shape) from the first and second ends 380E, 390E. Other embodiments of the clip may include a clip with any appropriate shape (e.g., a triangular shape). The clip may be made of any suitable material that is sufficiently flexible to allow the cord 300 to slide between the first and second ends 380E, 390E and sufficiently stiff to allow the first and second ends 380E, 390E to pinch the cord 300 when the cord 300 is between the first and second ends 380E, 390E.

The first end 380E and second end 390E may include a biasing mechanism to bias the first end 380E toward the second end 390E to lock the cord 300 between the first end 380E and the second end 390E. As may be understood from FIGS. 8E and 8F, as the cord 300 slides between the first end 380E and second end 390E, the clip opens slightly to allow the cord 300 to pass between the first and second end 380E, 390E. As may be understood from FIG. 8F, when the cord 300 is between the first and second ends 380E, 390E, the biasing mechanism biases the first and second ends 380E, 390E together to pinch the cord 300 and lock the cord 300 in place. When the cord 300 is between the first and second ends 380E, 390E, the first and second ends 380E, 390E may exert opposing lateral forces on the cord 300 that facilitate locking the cord 300 when the drop away arrow rest 10 is in the second, ready-to-fire position.

Figure 8G:
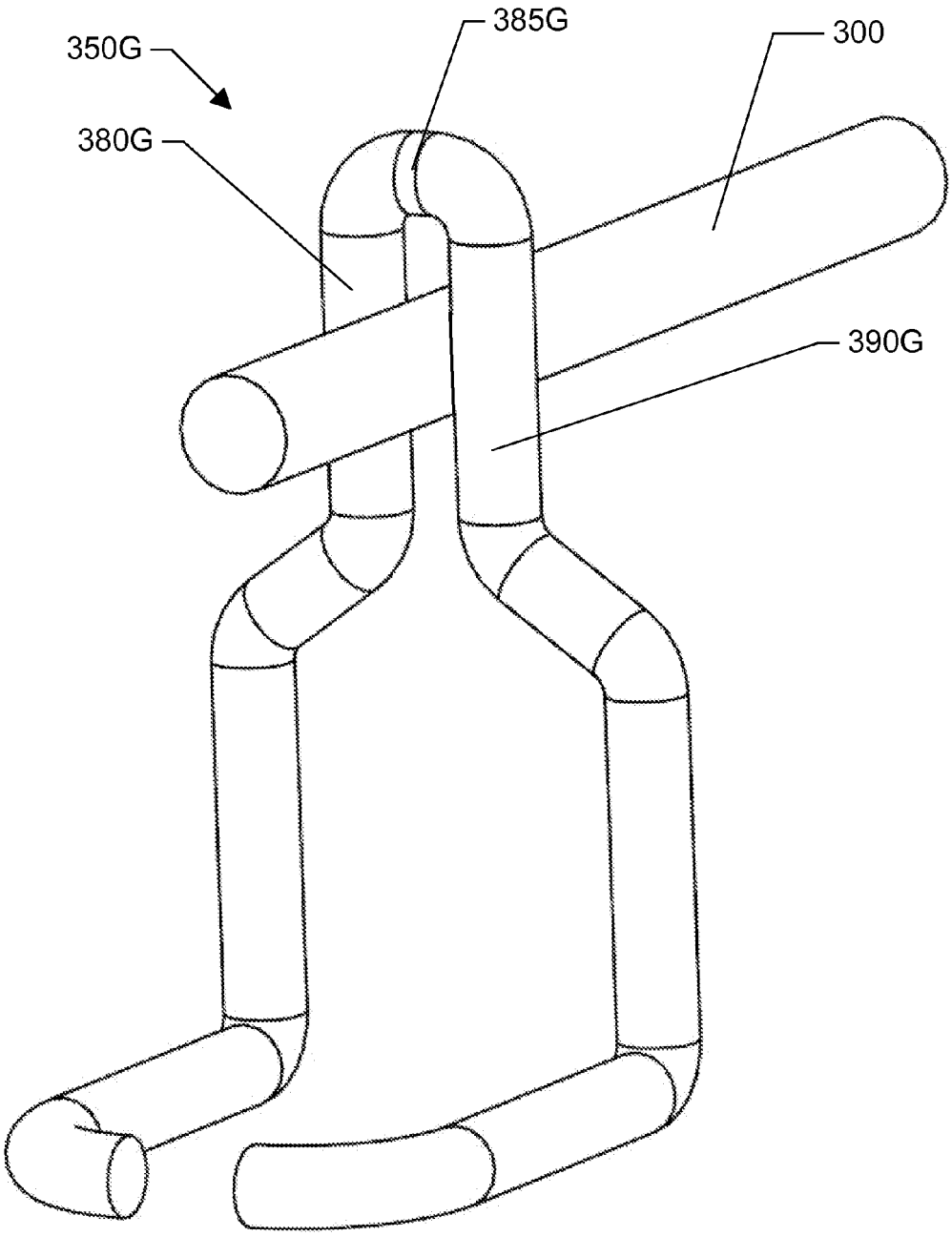
FIG. 8G is a perspective view of an alternative embodiment of the locking mechanism of FIG. 8E.
Figure 8H:
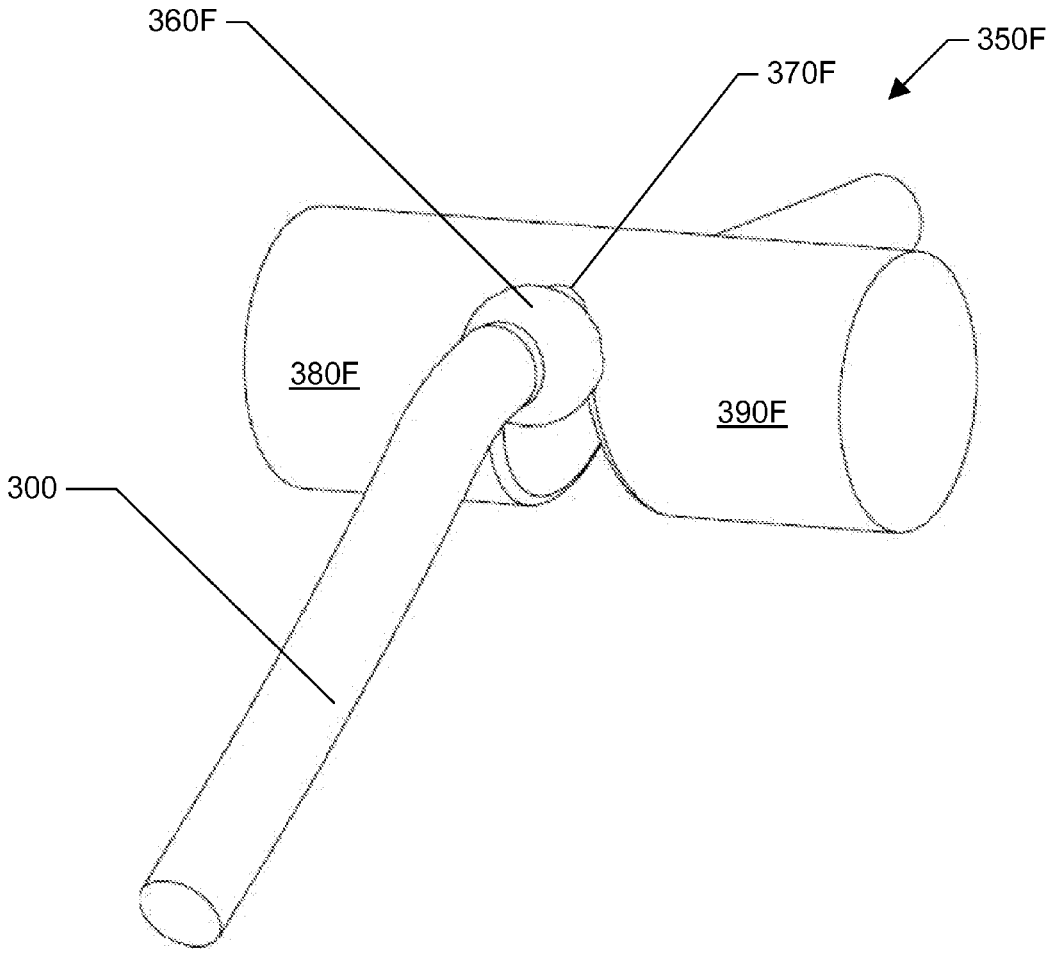
FIG. 8H is a perspective view of a sixth embodiment of a locking mechanism.

In particular embodiments, such as the embodiment shown in FIG. 8G, an upper connecting portion 385G may extend between an upper end of the first end 380G and the second end 390G. In the embodiment shown in FIG. 8G, the upper connecting portion 385G is a substantially U-shaped tubular member. In particular embodiments, the upper connecting portion 385G may be adapted to prevent the cord 300 from slipping out of the top portion of the locking mechanism 350G when the cord 300 is in a locked position between the first and second ends 380G, 390G.

Sixth Locking Mechanism Embodiment

A sixth embodiment of the locking mechanism 350F is shown in FIG. 8H. The sixth embodiment of the locking mechanism includes a bulge 380F on the cord 300 and a notch 390F. In the embodiment shown in FIG. 8H, the bulge 360F comprises a bead. In other embodiments, the bulge may comprise a knot or any other appropriate bulge. In the sixth embodiment of the locking mechanism 350D, the notch 370D is sufficiently wide to allow the cord 300 to slide within the notch 370D and sufficiently narrow to prevent the bulge 360D from sliding past the notch 370D.

As may be understood from FIG. 8H, the bulge 360D is adapted to substantially engage (e.g., engage) with the notch 370D to lock the cord 300 in place. The bulge 360F may be disposed on the cord 300 such that the bulge 360F is adapted to substantially engage (e.g., engage) with the notch 370F when the drop away arrow rest 10 is in the second, ready-to-fire position.

Exemplary Locking Mechanism Functionality

Figure 9:
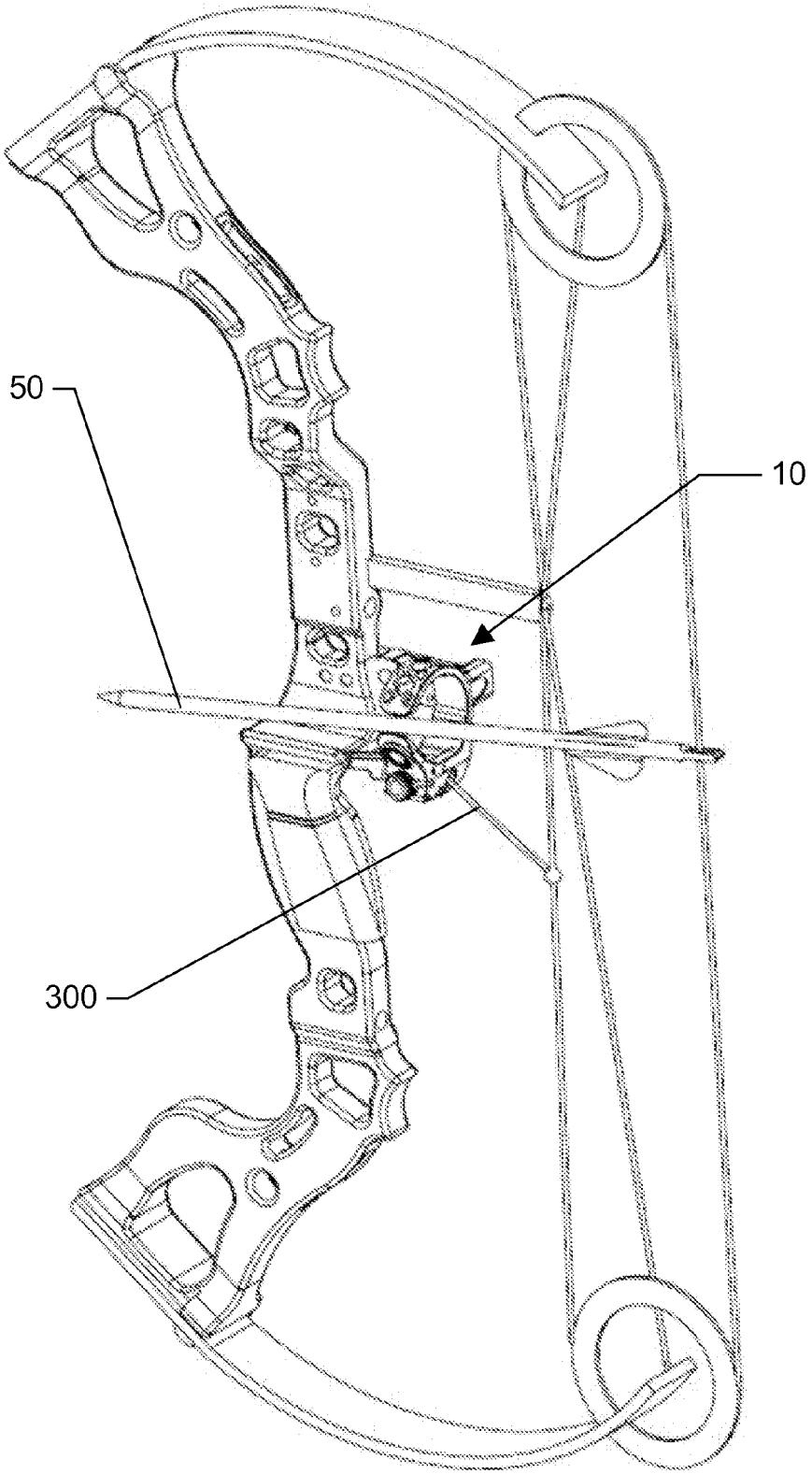
FIG. 9 is a perspective view of the drop away arrow rest of FIG. 1 on a bow in a first, dropped away position.
Figure 10:
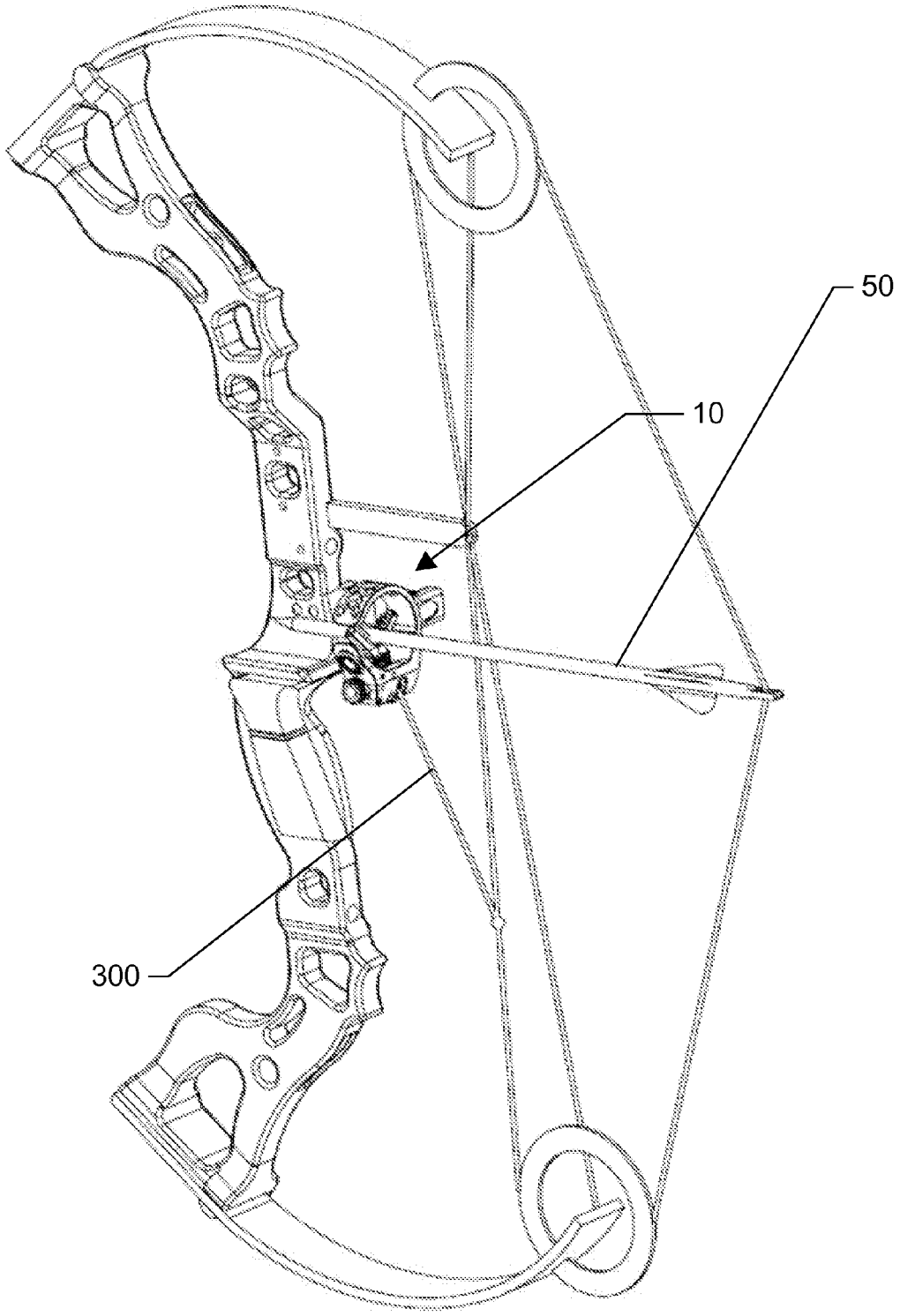
FIG. 10 is a perspective view of the drop away arrow rest and bow of FIG. 9 in a second, ready-to-fire position.
Figure 11:
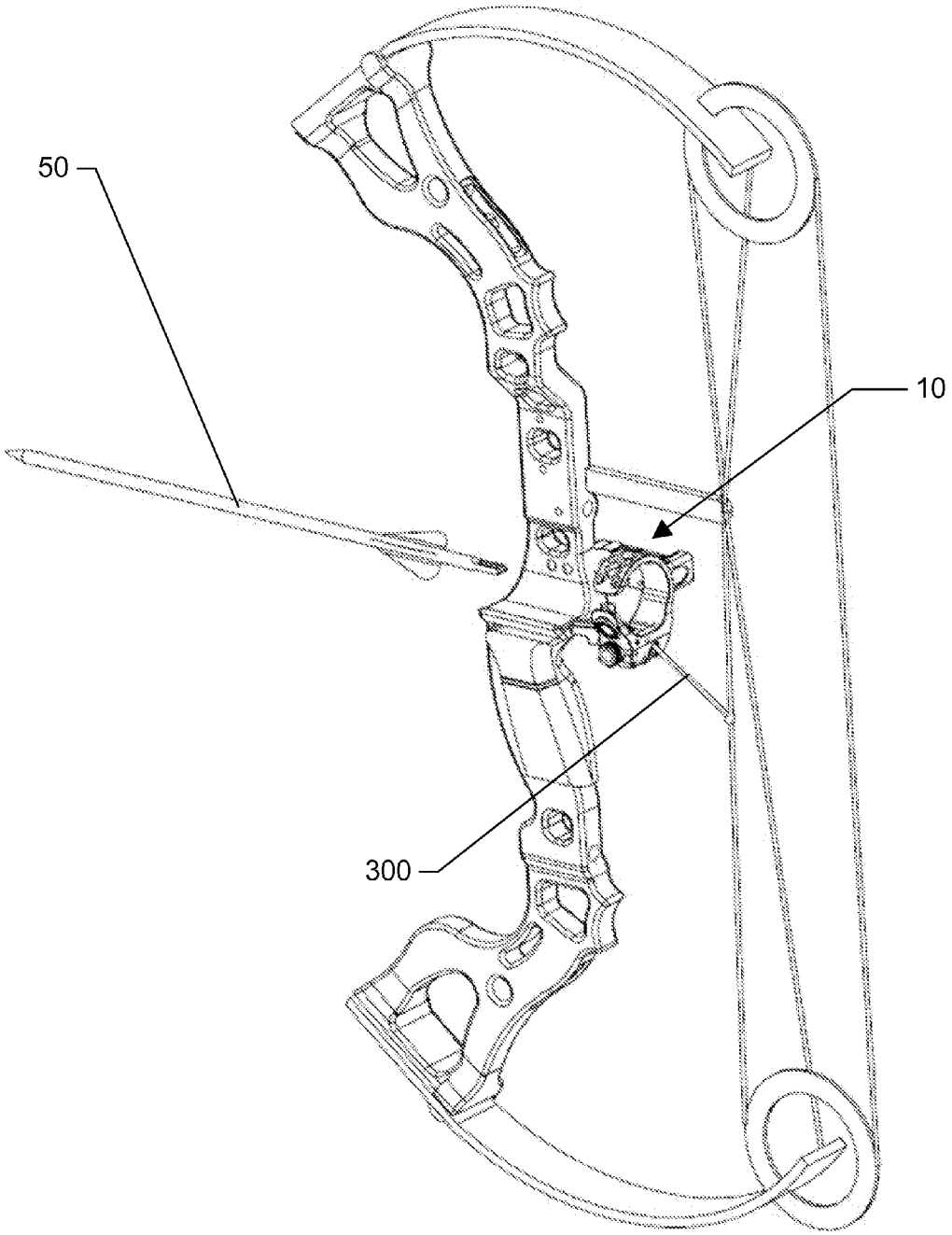
FIG. 11 is a perspective view of the drop away arrow rest and bow of FIG. 9 immediately following the firing of the arrow.

In various embodiments of the locking mechanism 350, the locking mechanism 350 functions by pinching the cord 300 in order to lock the drop away arrow rest 10 in the second, ready-to-fire position. In various embodiments, as shown in FIGS. 9-11, the cord 300 is coupled with the drawstring of the archery bow such that when the drawstring is drawn, the cord 300 is pulled. Because the cord 360 is adapted to move the drop away arrow rest 10 from the first, dropped away position to the second, ready-to-fire position when pulled, drawing the drawstring moves the drop away arrow rest 10 into the second, ready-to-fire position.

In various embodiments, as the drawstring is drawn, the cord 300 slides up between the two pinching sides of the locking mechanism 350. The two pinching sides of the locking mechanism may include two cylinders as in the first locking mechanism embodiment, two springs and two ball bearings as in the second locking system embodiment, or any other suitable locking mechanism. As the cord 300 slides between the two pinching sides of the locking mechanism 350, the two pinching sides may pinch against the cord 300, substantially locking (e.g., locking) the cord 300 in place. The cord 300 may be adapted to lock between the two pinching sides of the locking mechanism 350 when the drop away arrow rest 10 is in the second, ready-to-fire position.

The locking mechanism 350 may be further adapted to release when the archery bow is fired such that the drop away arrow rest 10 returns to the first, dropped away position when the archery bow is fired. In certain embodiments, the release of the drawstring may cause the cord 300 to release from between the two pinching sides of the locking mechanism 350, allowing the biasing mechanism of the V-shaped launcher 200 to bias the drop away arrow rest 10 back to the first, dropped away position. As the drawstring is released to fire an arrow, the force of the drawstring pulls the cord 300 from between the two pinching sides, releasing the locking mechanism. As shown may be understood from FIG. 11, in the first, dropped away position, the drop away arrow rest 10 may be adapted to not substantially interfere with (e.g., not interfere with) the flight of the arrow.

Alternative Embodiments

Alternative embodiments of the drop away arrow rest 10 may comprise components that are, in some respects, similar to the various components described above. Selected distinguishing features of these alternative embodiments are discussed below.

1. Mixed Locking Mechanism

Various embodiments of the locking mechanism may include any appropriate combination of the locking mechanisms described in the first, second, third, fourth, fifth and sixth embodiments described above. For example, a locking mechanism may include a first biasing mechanism and a cylinder as well as a second biasing member and a ball bearing. In such an embodiment, the first biasing mechanism may bias the cylinder against the ball bearing, and the second biasing mechanism may bias the ball bearing against the cylinder. In such an embodiment, the resulting opposing lateral force may facilitate the locking of the cord 300.

2. Non C-Shaped Enclosure

Figure 6:
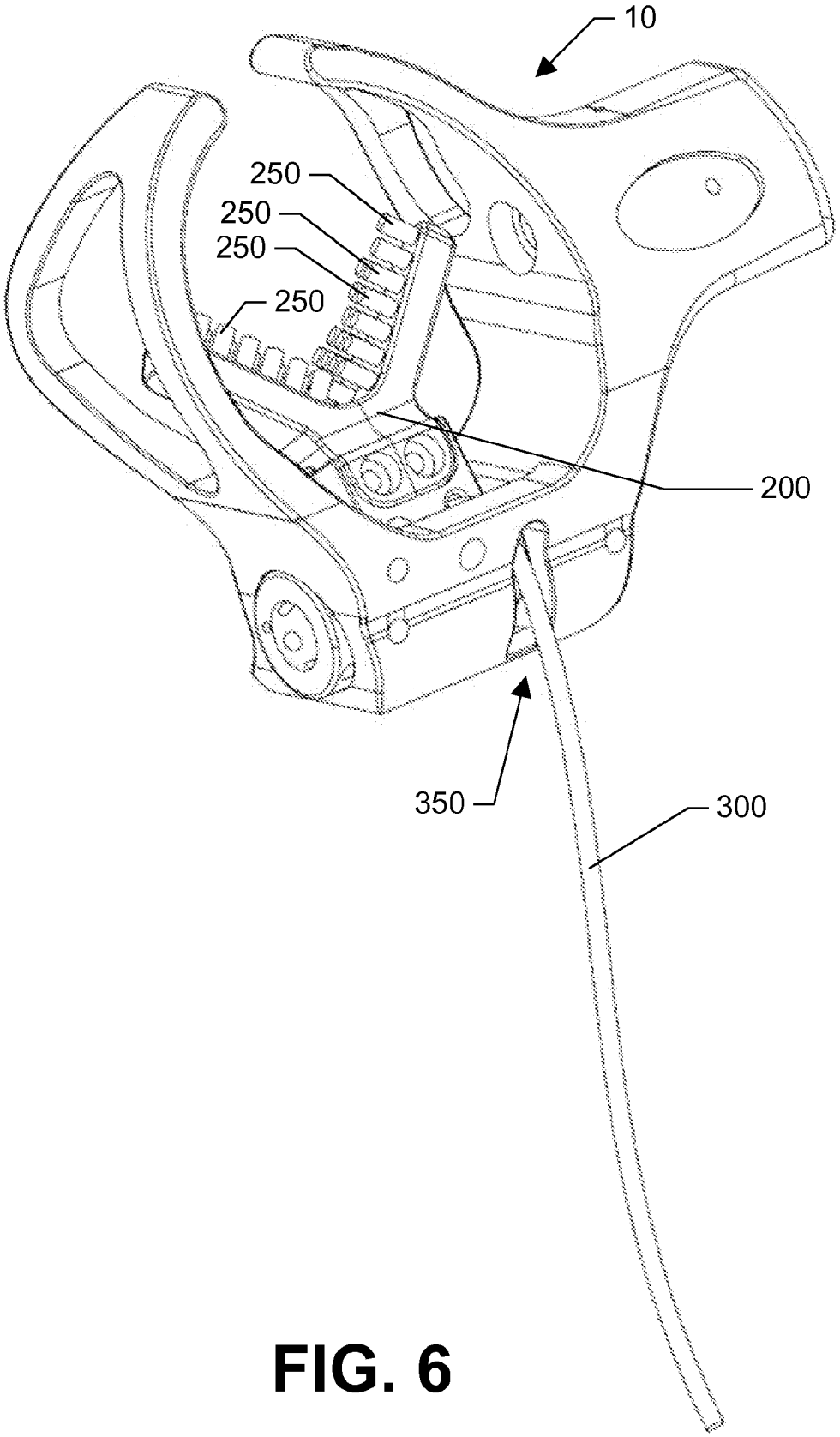
Figure 7:
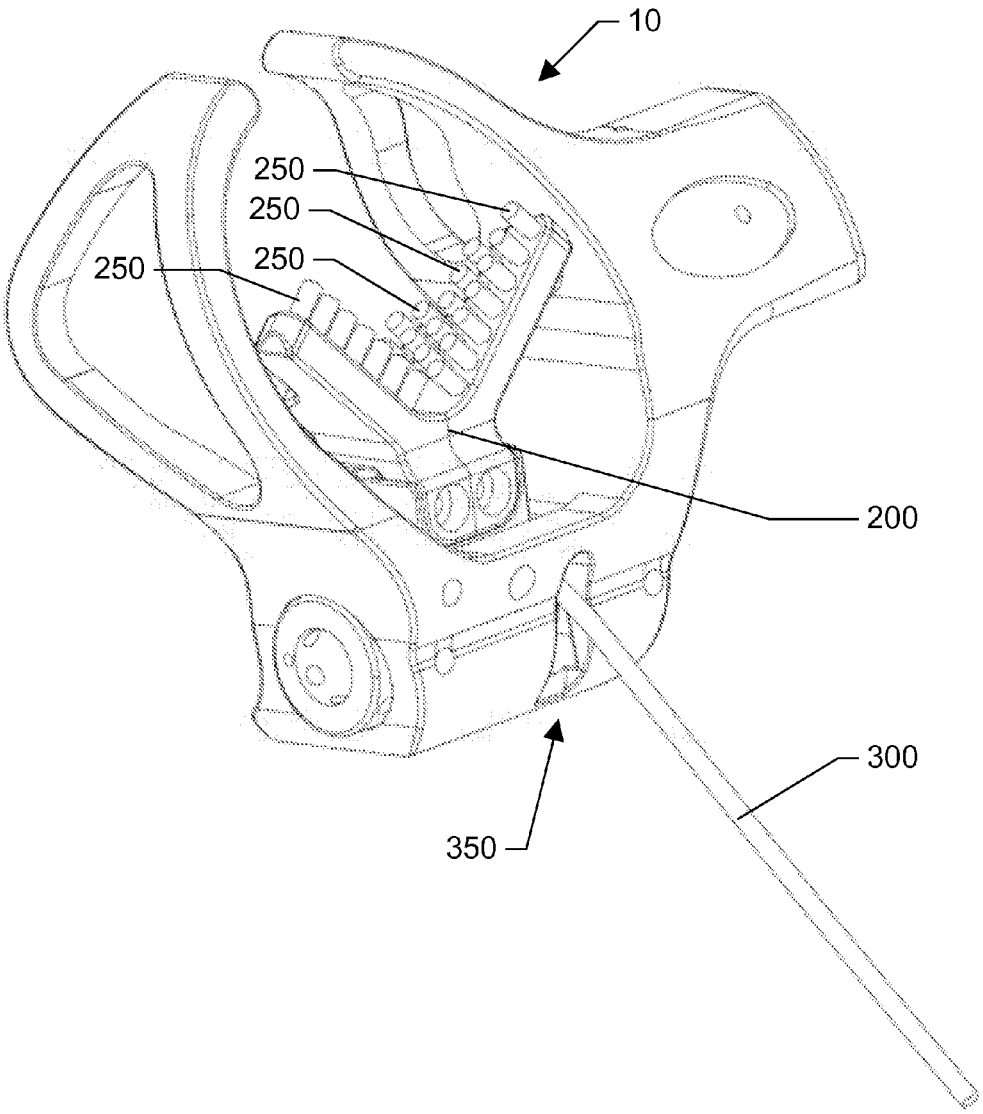

Particular embodiments of the drop away arrow rest 10 may include an enclosure other than a C-shaped enclosure. Other embodiments may include no enclosure around the V-shaped launcher 200. In the embodiment shown in FIGS. 5-7, the drop away arrow rest includes a substantially U-shaped (e.g., U-Shaped) enclosure with an opening at the top of the enclosure for the insertion of an arrow.

3. Other Lifting Arrow Rests

Particular embodiments of an arrow rest may include other suitable mechanisms to move an arrow into a firing position. For example, rather than a V-shaped launcher 200, particular embodiments may include an arrow rest that rotates to lift an arrow into a firing position. In particular embodiments, a locking mechanism 350 may be adapted to lock any arrow rest in a firing position, or any other suitable position.

CONCLUSION

Many modifications and other embodiments of the invention will come to mind to one skilled in the art to which this invention pertains having the benefit of the teachings presented in the foregoing descriptions and the associated drawings. For example, as will be understood by one skilled in the relevant field in light of this disclosure, the invention may take form in a variety of different mechanical and operational configurations. Therefore, it is to be understood that the invention is not to be limited to the specific embodiments disclosed and that the modifications and other embodiments are intended to be included within the scope of the appended exemplary concepts. Although specific terms are employed herein, they are used in a generic and descriptive sense only and not for the purposes of limitation.

I claim:

1. An arrow rest for a bow comprising:

a launcher that is adapted to support an arrow, said launcher being mounted to selectively move between a first position and a second, ready-to-fire position;

a cord that is connected to move said launcher, in response to said cord being pulled, from said first position to said second, ready-to-fire position and to thereby lift an arrow supported at least partially by said launcher, into a ready-to-fire position; and a locking mechanism that:

locks said cord in a fixed position with respect to said locking mechanism so that said launcher is maintained in said second, ready-to-fire position without the bow being drawn, and releases said cord from said fixed position when the bow is sufficiently drawn so that said cord moves with respect to said locking mechanism thereby allowing said launcher to move from said second position into said first position when the bow is fired.

2. The arrow rest of claim 1, wherein said locking mechanism comprises:

a first cylinder;

a second cylinder disposed substantially co-linearly with said first cylinder; and a biasing mechanism adapted to selectively bias said first cylinder toward said second cylinder so that said first and second cylinders exert opposing forces on said cord when said portion of said cord is between said first cylinder and said second cylinder.

3. The arrow rest of claim 2, wherein:

said cord is adapted to move into said fixed position between said first cylinder and said second cylinder as said launcher is moved from said first position to said second, ready-to-fire position.

4. The arrow rest of claim 2, wherein:

said first cylinder comprises at least one tooth;

said second cylinder also comprises at least one tooth; and said at least one tooth of said first cylinder and said at least one tooth of said second cylinder are adapted cooperate to hold said cord in place as said first and second cylinders exert said opposing forces on said cord.

5. The arrow rest of claim 4, wherein:

said first cylinder comprises a plurality of teeth; and said second cylinder comprises a plurality of teeth.

6. The arrow rest of claim 2, wherein:

said biasing mechanism is a first biasing mechanism;

said locking mechanism comprises a second biasing mechanism, wherein:

said second biasing mechanism is adapted to bias said second cylinder toward said first cylinder.

7. The arrow rest of claim 1, wherein said locking mechanism comprises:

a first ball bearing;

a second ball bearing disposed substantially co-linearly with said first ball bearing; and a biasing mechanism adapted to bias said first ball bearing toward said second ball bearing so that said first and second ball bearings exert said opposing forces on said cord when said portion of said cord is between said first ball bearing and said second ball bearing.

8. The arrow rest of claim 7, wherein said biasing mechanism comprises a spring.

9. The arrow rest of claim 1, wherein said locking mechanism comprises:

(A) a first flexible member having an end portion; and (B) a second flexible member having an end portion, wherein:

said second flexible member and said first flexible member are substantially co-planar; and said end portion of said first flexible member is disposed substantially adjacent said end portion of said second flexible member;

(C) a first biasing mechanism that is adapted to bias said end portion of said first flexible member toward said end portion of said second flexible member; and (D) a second biasing mechanism that is adapted to bias said end portion of said second flexible member against said first end of said first flexible member; wherein:

said opposing lateral forces are exerted on said cord as a result of:

(1) said first biasing mechanism biasing said end portion of said first flexible member toward said end portion of said second flexible member; and (2) said second biasing mechanism biasing said end portion of said second flexible member toward said end portion of said first flexible member.

10. The arrow rest of claim 1, wherein said locking mechanism comprises:

(A) a first lock portion defining a first face;

(B) a second lock portion, wherein:

said second lock portion defines a second face; and a surface of said first face is adapted to selectively enter a recess defined by a surface of said second face; and said second lock portion is rotatably mounted to pivot about a particular axis of rotation; and (C) a biasing mechanism; wherein:

said first lock portion is disposed such that said first face of said first lock portion substantially faces said second face of said second lock portion;

said biasing mechanism is adapted to bias said second lock portion to rotate about said axis of rotation toward said first lock portion; and said opposing lateral forces are exerted on said cord as a result of said biasing mechanism biasing said second lock toward said first lock portion when said cord is between said first lock portion and said second lock portion.

11. The arrow rest of claim 10, wherein said first and second lock portions are at least substantially coplanar.

12. The arrow rest of claim 1, wherein:

said cord is substantially coupled with a bowstring of said bow;

said cord is adapted to move said arrow rest from said first position to said second, ready-to-fire position when said bowstring is drawn; and said first position is a dropped away position.

13. The arrow rest of claim 12, wherein said locking mechanism is adapted to release said cord in response to said arrow being fired from said bow.

14. An arrow rest comprising;

a launcher that is adapted to support an arrow, said launcher being mounted to selectively move between a first position and a second, ready-to-fire position;

a cord that is connected to move said launcher, in response to said cord being pulled, from said first position to said second, ready-to-fire position and to thereby lift an arrow supported at least partially by said launcher, into a ready-to-fire position; and a clip disposed adjacent said launcher, wherein:

said clip comprises a first end, a second end, and a biasing mechanism;

said biasing mechanism is adapted to bias said first end and said second end toward each other; and when said cord is moved between said first and said second ends of said clip, said clip locks said cord in a fixed position with respect to said clip so that said launcher is maintained in said second, ready-to-fire position without the bow being drawn, and said clip releases said cord from said fixed position when the bow is sufficiently drawn so that said cord moves with respect to said clip thereby allowing said launcher to move from said second position into said first position when the bow is fired.

15. The arrow rest of claim 14, wherein said cord is adapted to slide between said first end and said second end of said clip when said cord is pulled.

16. An arrow rest comprising:

a launcher that is adapted to support an arrow, said launcher being mounted to selectively move between a first position and a second, ready-to-fire position;

a cord that is connected to move said launcher, in response to said cord being pulled, from said first position to said second, ready-to-fire position and to thereby lift an arrow supported at least partially by said launcher, into a ready-to-fire position; and a locking mechanism disposed adjacent said launcher, wherein:

said cord comprises a bulge; and said bulge cooperates with said locking mechanism to:

lock said cord in a fixed position with respect to said locking mechanism so that said launcher is maintained in said second, ready-to-fire position without the bow being drawn, and release said cord from said fixed position when the bow is sufficiently drawn so that said cord moves with respect to said locking mechanism thereby allowing said launcher to move from said second position into said first position when the bow is fired.

17. The arrow rest of claim 16, wherein said bulge comprises a knot in said cord.

18. The arrow rest of claim 16, wherein said bulge comprises a bead.

19. The arrow rest of claim 16, wherein:

said locking mechanism comprises a stop structure defining a notch; and said bulge is adapted to cooperate with said locking mechanism to lock said arrow rest in said second, ready-to-fire position by engaging a surface of said stop structure adjacent said notch.

20. The arrow rest of claim 19, wherein:

said cord is substantially coupled with a bowstring of an archery bow; and said cord is adapted to move said arrow rest from said first position to said second, ready-to-fire position in response to said bowstring being drawn.

21. The arrow rest of claim 20, wherein:

said cord is adapted to slide past said notch while said bowstring is being drawn;

said bulge is disposed adjacent said cord such that said bulge is positioned substantially immediately behind said notch when said arrow rest is in said second, ready-to-fire position; and said bulge is adapted to cooperate with said stop structure to hold said cord in place when said arrow rest is in said second, ready-to-fire position.

* * * * *